United States Patent [19]

Bratschi

[11] 4,227,564

[45] Oct. 14, 1980

[54] CURTAIN TRACK WITH TRAVERSE CORD

[75] Inventor: Konrad Bratschi, Haldenweg 29, 3074 Muri, Switzerland

[73] Assignees: K. Bratschi; Silent Gliss, both of Muri, Switzerland

[21] Appl. No.: 7,520

[22] Filed: Jan. 29, 1979

[30] Foreign Application Priority Data

Jan. 27, 1978 [CH] Switzerland ..... 938/78

[51] Int. Cl.[3] ..... A47H 5/00

[52] U.S. Cl. ..... 160/345; 160/126

[58] Field of Search ..... 160/340-347, 160/126

[56] References Cited

U.S. PATENT DOCUMENTS

| | | | |
|---|---|---|---|
| 1,215,126 | 2/1917 | Donnelly | 160/344 |
| 1,630,778 | 5/1927 | Boyd | 160/341 |
| 1,857,768 | 5/1932 | Reubel | 160/346 |
| 2,564,995 | 8/1951 | Rakeman | 160/346 |

*Primary Examiner*—Peter M. Caun

*Attorney, Agent, or Firm*—Weiser, Stapler & Spivak

[57] ABSTRACT

The curtain track with a traverse cord has at least one guidance channel in which the curtain hangers to which the curtain is to be attached are longitudinally freely movable. The cord is also positioned within this track and is led over turn-around or exit rollers at the end of the track. The curtain hangers are in frictional engagement with the cord, so that they can be actuated by the cord but stop when a resistance arises, whereupon the cord slips past them. The curtain can be operated both with the traverse cord and also by throwing.

11 Claims, 7 Drawing Figures

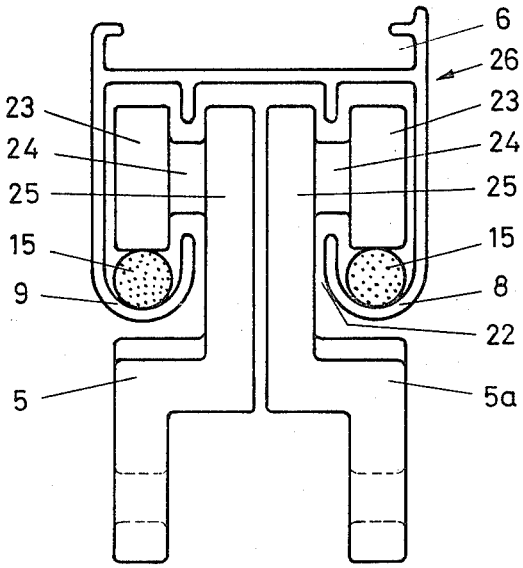
Fig. 3
Fig. 4
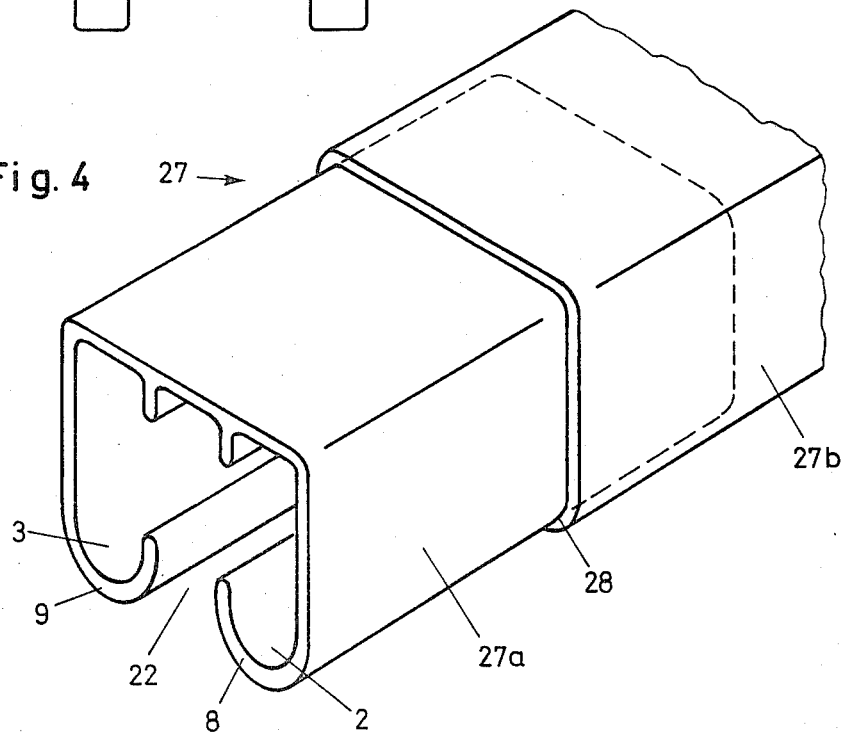
Fig. 5
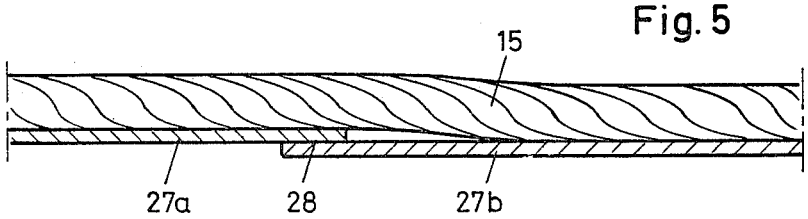

CURTAIN TRACK WITH TRAVERSE CORD

The invention relates to a curtain track with traverse cord and longitudinally displaceable curtain carriers.

In curtains which are destined for various uses there is frequently too little consideration given to the needs of the user. Especially in hotels and public buildings the curtains are operated by many different people, some of whom are accustomed to throw them from side to side while others prefer cord operation. Thus it is customary in the United States to provide curtains with traverse cords whereas Europeans generally prefer curtains which are intended to be thrown aside.

The curtains are frequently not carefully used so that known curtains with traverse cords often are subject to the risk of overloading and resulting ripping loose of the curtains. This is especially so when these curtains are closed and opened by direct pull of the hand upon the free panel instead of by means of the traverse cord.

From the structural standpoint, known curtain tracks must be provided with special master slides which are connected to the traverse cord and which pull the curtain along upon operation of the latter. In the event of too strong a pull upon the cord or the curtain, the connection between the curtain and the slides can break, or the entire rod can be pulled down.

An arrangement of this type for opening and closing curtains is described in U.S. Pat. No. 2,201,804. This apparatus is particularly suited for heavy, tall stage curtains because, in addition to the master slide which is fixedly attached to the cord, there are also provided auxiliary slides which interact with the cord only during opening of the curtain and stabilize the curtain in order to prevent its oscillation. This involves a device for a highly specialized application which is scarcely needed for short curtains.

For curtains with master slides, installation and adjustment require much effort. The master slides must be precisely positioned and coordinated with each other, otherwise the curtain does not close or open. To position the master slides on the string the distance must be determined before mounting of the track along the cord. Post-adjustment of the master slides after mounting of the track is difficult and involves much effort.

German Pat. No. 678,758 discloses a draw arrangement for curtains in which individual curtain carriers are provided as intermediate carriers and have rollers which move upon the traverse cord. To center the traverse cord and to prevent tilting of the curtain carriers the cord is then centered by means of the rollers. The intermediate carriers which are held only by the cord and are not supported by the track hang down and this is undesirable. In order to somewhat reduce the bowing, the traverse cord is stretched by means of a heavy counterweight. It is also undesirable that, when the curtain is closed, the traverse cord is completely unguided over an extended distance and hangs down here, too, despite the stretching. To operate this curtain, the traverse cord has to be attached to an auxiliary carrier or a main curtain carrier. Otherwise it would simply be drawn through below the easily rotatable rollers, without actuating the curtain. The installation of this draw arrangement is hard to carry out because the cord must be threaded into each curtain carrier.

Accordingly, it is the object of the invention to provide a curtain track with traverse cord of the initially described type in which the disadvantages of the known arrangements are avoided. It is another object that the curtain track with traverse cord shall have few individual components so that its manufacture is less expensive. The installation is to be simple and the operation is to be convenient and incomplicated, both with the traverse cord as well as with a throw rod or by manual pull upon the free hanging panel. Moreover, it is an object that it be possible to provide an actuating device, e.g. an electrical actuator, which does not involve any difficulties insofar as the installaton of the end switches. Finally, it is an object that the curtain track be capable of assembly from individual track portions in telescopic fashion without the transition points impairing the displacement of the moving elements.

These and other objects which will appear are accomplished in accordance with the invention by engaging the curtain carriers frictionally with the cord. The latter is led within at least one channel lengthwise of the curtain track. The curtain carriers are indirectly supported upon the track via the cord. The overall system is such that, upon operation of the traverse cord, the carriers are carried along by the cord due to the engaging friction whereas, when the engaging frictional force is exceeded, the cord slips relative to the carriers.

In a preferred embodiment of the invention the curtain track consists of track portions which are inserted into each other in telescopic manner. Extendable curtain tracks are of course well known, e.g. from German Pat. No. 747,108. The know curtain carriers which roll upon the tracks are subject to an impact at each steplike transition point and this is very undesirable. Because, in the present invention, the carriers are in contact only with the cord which covers the transition points, no impacts are possible and this is very desirable.

For further details reference is made to the discussion which follows of illustrative embodiments of the invention and to the accompaying drawings wherein:

FIG. 3 shows a cross-section through another embodiment of a curtain track with traverse cord and two displacement channels;

FIG 4 shows a curtain track consisting of two track portions inserted into each other in telescopic fashion;

Figure 6:
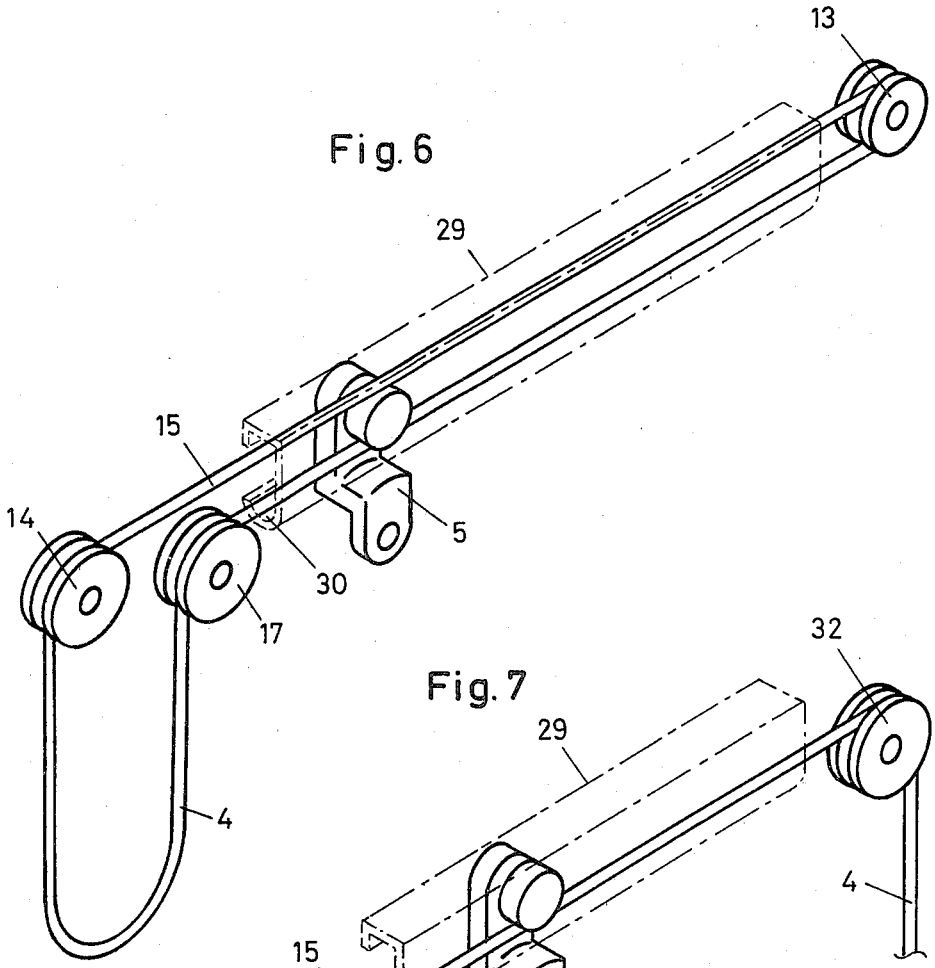
Figure 7:
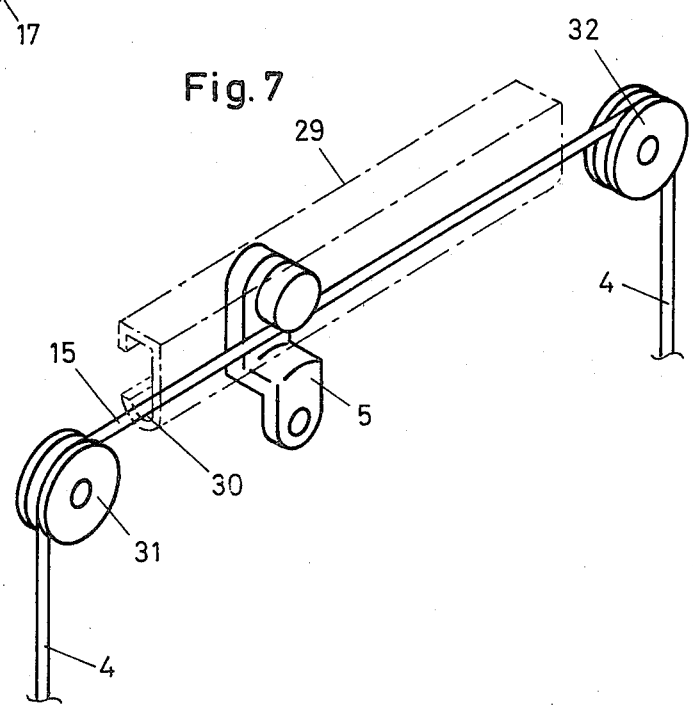

FIG. 5 diagramatically illustrates the overlap region of the multipart curtain track of FIG. 4;

FIG. 6 shows an embodiment of a curtain track with traverse cords with a single channel for displacement; and FIG. 7 shows a further embodiment of a curtain track with a single displacement channel.

Figures 1, 2:
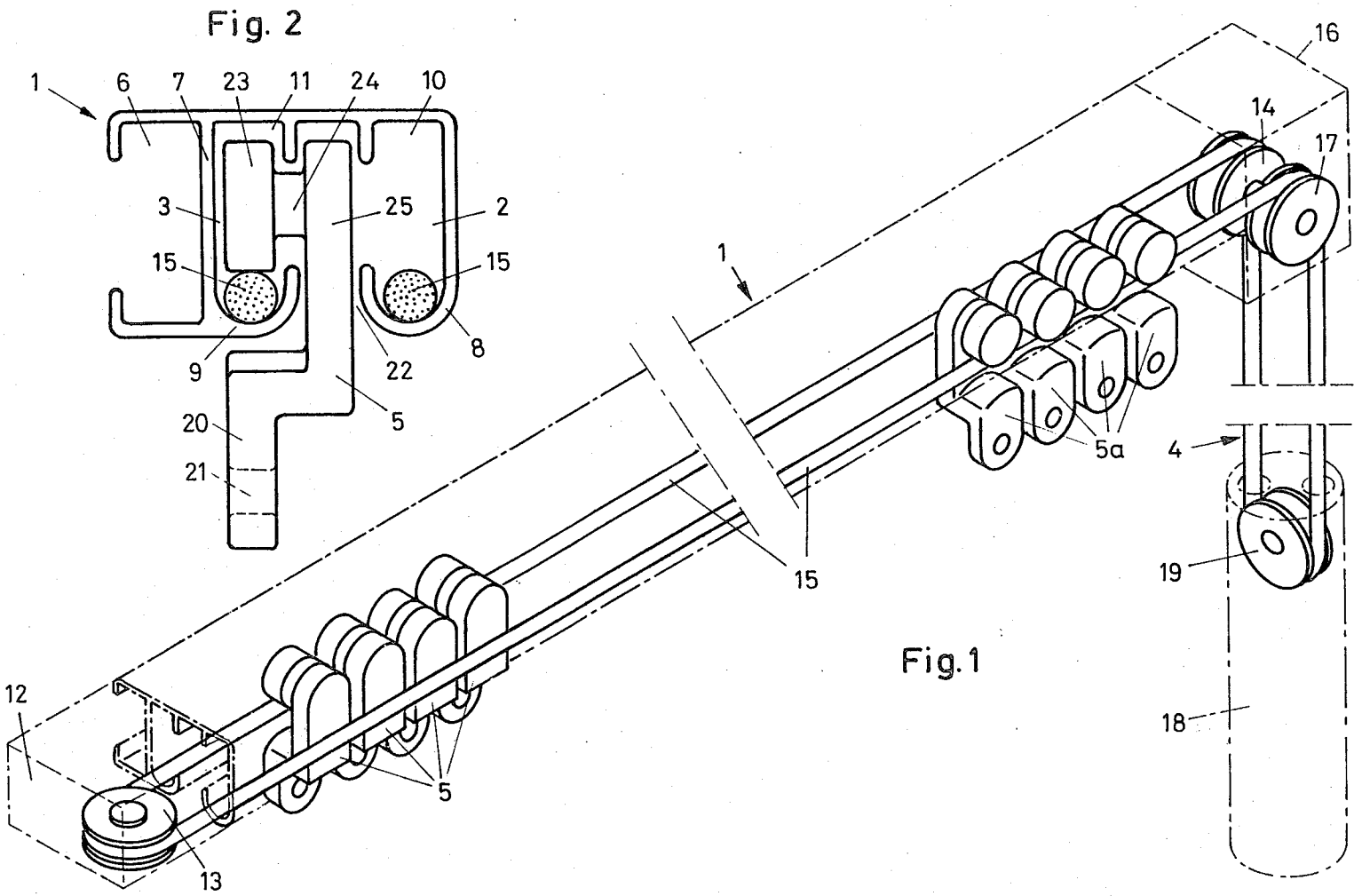
FIG. 1 shows a curtain track with traverse cord and displacement channels in perspective view.
FIG. 2 shows a cross-section through the curtain track with traverse cord of FIG. 1.

The profile of curtain track 1 as illustrated in FIGS. 1 and 2 consists of two longitudinal channels 2, 3 positioned symmetrically with respect to each other for the traverse cord 4 and movable elements 5, 5*a* as well of an attachment channel 6 in which there are insertable plastic buttons which are known in themselves and therefore not illustrated in detail, in order to mount curtain track 1 on the wall. A lengthwise intermediate partition 7 separates the attachment channel 6 from longitudinal channels 2, 3.

Each longitudinal channel 2, 3 consists of a lower trough-shaped portion 8, 9 and an upper recessed portion 10, 11 with U-shaped cross-section.

At one end 12 of curtain track 1 a turn-around roller 13 is positioned and at the opposite end 16 two exit rollers 14, 17 are rotatably attached.

The endless woven cord 15 of traverse cord 4 extends from one exit roller 17 into the one longitudinal channel 2, from there to turn-around roller 13 and then back again in the other longitudinal channel 3 to the second exit roller 14. The downwardly hanging operating portion of the traverse cord 4 is weighted by means of weight 18, there being within weight 18 an additional turn-around roller 19 for the cord 15. The cord 15 lies within trough-shaped portions 8, 9 of longitudinal channels 2, 3 and is guided by these.

Movable elements 5, 5*a*, which are made of unitary synthetic plastic, are guided longitudinally movably within longitudinal channels 2, 3. More specifically one group 5 is positioned within the inner longitudinal channel 3 and the other group 5*a* within the outer longitudinal channel 2.

A lower portion 20 of movable elements 5, 5*a* extends out of the curtain rod 1 downwardly through the space 22 provided between the two troughs 8, 9. It is provided with an aperture 21 in which the curtain is attached. To movable element 5, 5*a* there is further attached a round projection 23 which rests upon cord 15 and is pressed against the latter through gravity. Projection 23 is guided by recess 10, 11 of longitudinal channels 2, 3 and is connected via neck 24 with the middle portion 25 of the movable elements. The projection is in frictional contact with the cord. Its rounded shape makes sure that even if there is slight oscillation of the curtain there is always a point contact bearing so that the frictional force always remains the same.

The two curtains, which are not further illustrated, are attached in customary manner respectively at end 12 or 16 of curtain track 1 and hung from movable elements 5, 5*a*. When the traverse cord 4 is actuated, both groups 5, 5*a* of movable elements are displaced by means of cord 15 toward each other in the direction of the middle of curtain track 1. As soon as the curtain fold which lies between the end of the track and the first movable element has been straightened out this first movable element stops and cord 15 slides by below its round projection 23. This process is repeated until all the movable elements are stationary and the two free hanging panels touch. If the pull on traverse cord 4 continues, there is no danger that the curtain or the traverse cord is damaged because the cord is simply pulled through below projections 23 with sliding friction. During opening of the curtain the sliding elements are displaced towards the ends of the curtain track until they abut, whereupon the cord then again slips past them.

The curtain can also be operated without difficulty without the traverse cord, eg. by means of a push rod, a throw rope, or by hand simply by pulling on the free hanging panel. In that case the movable elements glide upon the stationary cord until the curtain is closed or opened.

The curtain track 26 of FIG. 3 differs from that of FIGS. 1 and 2 in that the attachment channel 6 is not positioned alongside but above and in that the intermediate space 22 between the two troughs 8 and 9 is broader. This makes it possible to displace the movable elements 5, 5*a* located in the two displacement channels 2, 3 past each other in the region of the free curtain ends in order that the curtan shall close better due to this overlap. The other ends of the curtain portions are hooked into the track ends by means of fixing attachments which are not further illustrated.

In FIG. 4 there is shown a two-part curtain track 27 made of rolled sheet metal. To insure complete protection from rust the surface may, for example, be treated with baked enamel. Rolled curtain tracks can be made to closer tolerances compared with extruded light metal curtain tracks. This is particularly advantageous for the telescopic insertion into each other of the two curtain portions 27*a*, 27*b*. The abutment point 28 which exists between the two track portions 27*a*, 27*b* is not harmful because it is bridged by cord 15. The movable elements 5, 5*a* are positioned above cord 15 and do not slide directly on the track.

In further embodiments of the curtain track according to FIGS. 6 and 7 the track 29 has only a single guidance channel 20 within which movable elements 5 are guided. In the embodiment of FIG. 6 there are provided at the ends of the track a turn-around roller 13 and two exit rollers 14, 17, respectively, so that the traverse cord 4 can be operated only from one side. In the embodiment of FIG. 7 both track ends are provided with an exit roller 31, 32 respectively. This curtain can be operated from both sides. In contrast to the other arrangements the cord in this case is not of endless configuration.

The arrangement described exhibits various advantages relative to known curtains with traverse cords:

It is not necessary to attach any auxiliary carriers to the cord in order to cause the curtain to move. This simplifies the installation and no adjustment of the auxiliary carriers is necessary.

With the endless cord there is no end point attachment so that the cord cannot rip or tear out. The cord simply slips past and this eliminates the danger of overloading.

Several, unequally long curtains can be simultaneously operated, for tall and short windows, balcony doors, etc. In contrast, for known curtain draws with end switches asymmetrical curtains are not possible.

The curtains can also be actuated individually and independently of each other by throwing, e.g. in order to close a window surface on one side only. Also, this is desirable as a safety factor in case of fire because the curtain can be immediately pulled and opened.

The curtain track with traverse cord according to the invention has fewer components than known arrangements. It is less expensive to produce and reliable and trouble-free in operation.

The curtain arrangement according to the invention is also particularly suitable for electric drive, in which, for example, one of the rollers is driven. In contrast to known arrangements with couplings, adjustable end switches, etc., only a relatively cheap actuating switch is required. Also simple delay and time switches become possible requiring no high adjustment precision because, when the curtain is closed, the cord simply slips through and cannot tear out. As a result the curtain with electric drive is self-adjusting and can also be installed without difficulty by an unskilled worker.

Because the movable elements rest upon the cord and not directly on the track it becomes possible to provide telescopically adjustable curtain tracks which can be adapted simply to various requirements. The abutment points have no adverse effect whatsoever upon the sliding characteristics of the movable elements.

I claim:

1. Curtain track with traverse cord and longitudinally displaceable curtain hangers, wherein the hangers are frictionally engaged with the cord which is guided lengthwise in at least one channel of the track, the hangers bearing upon the track indirectly via the cord, the relationships being such that, upon actuation of the traverse cord the frictional engagement by the cord produces entrainment of the hangers, and, upon exceeding of the frictional engagement force the cord slips relative to the curtain hangers.

2. The curtain track of claim 1 wherein the curtain hangers are positioned above the cord and are pressed against the cord by gravity.

3. The curtain track of claim 1 wherein the cord is guided within a lower trough-shaped portion of the channel and the curtain hangers bear upon the bottom of the trough via the cord.

4. The curtain track of claim 1 wherein the curtain hangers have a round projection which rests upon the cord.

5. The curtain track of claim 4 wherein the projection is inserted into the channel and guided by it longitudinally.

6. The curtain track of claim 1 wherein the track is made of a light metal or plastic channel or rolled of sheet steel.

7. The curtain track of claims 1 and 3 wherein the track is composed of track segments which are telescopically inserted in each other and wherein the abutement point between the track segments is bridged by the cord.

8. The curtain track of claim 1 which comprises two parallel channels in which the curtain hangers are inserted.

9. The curtain track of claim 8 wherein a longitudinal slot is provided between the two trough-shaped portions of the two parallel channels, a lower extension of the curtain hanger to which the curtain is attachable projecting through the slot.

10. The curtain track of claim 1 wherein all the hangers are of similar construction and no master carriers connected to the cord are provided.

11. The curtain track of claim 1 which comprises only a single guidance channel in which the curtain hangers are guided.

* * * * *